US008652273B2

(12) United States Patent
Hong et al.

(10) Patent No.: US 8,652,273 B2
(45) Date of Patent: Feb. 18, 2014

(54) HIGH TENSILE STEEL FOR DEEP DRAWING AND MANUFACTURING METHOD THEREOF AND HIGH-PRESSURE CONTAINER PRODUCED THEREOF

(75) Inventors: Soon Taik Hong, Pohang (KR); Sung Ho Jang, Pohang (KR); Ki Hyun Bang, Pohang (KR)

(73) Assignee: Posco (KR)

( * ) Notice: Subject to any disclaimer, the term of this patent is extended or adjusted under 35 U.S.C. 154(b) by 182 days.

(21) Appl. No.: 12/741,703

(22) PCT Filed: Sep. 12, 2008

(86) PCT No.: PCT/KR2008/005432

§ 371 (c)(1),
(2), (4) Date: May 6, 2010

(87) PCT Pub. No.: WO2009/061073

PCT Pub. Date: May 14, 2009

(65) Prior Publication Data

US 2010/0236672 A1 Sep. 23, 2010

(30) Foreign Application Priority Data

Nov. 7, 2007 (KR) ..... 10-2007-0113290

(51) Int. Cl.

| | |
|---|---|
| ***C22C 38/22*** | (2006.01) |
| ***C22C 38/28*** | (2006.01) |
| ***C22C 38/32*** | (2006.01) |
| ***C22C 38/50*** | (2006.01) |
| ***C21D 1/28*** | (2006.01) |
| ***C21D 1/32*** | (2006.01) |

(52) U.S. Cl.
USPC ..... 148/330; 148/328; 148/335; 148/653; 148/654; 148/659; 148/663

(58) Field of Classification Search
USPC ..... 148/333–335, 653, 654, 659, 663, 330, 148/328
See application file for complete search history.

(56) References Cited

U.S. PATENT DOCUMENTS

| | | | | |
|---|---|---|---|---|
| 6,767,417 | B2 | 7/2004 | Fujita et al. | |
| 2007/0101789 | A1 * | 5/2007 | Kondo et al. | 72/97 |

FOREIGN PATENT DOCUMENTS

| | | | |
|---|---|---|---|
| JP | 9078184 | A | 3/1997 |
| JP | 11050148 | A | 2/1999 |
| JP | 2000273582 | A | 10/2000 |
| JP | 2002309345 | A | 10/2002 |
| JP | 2004143504 | A | 5/2004 |
| JP | 2004285456 | A | 10/2004 |
| JP | 2007023310 | A | 2/2007 |
| KR | 1998073737 | A | 11/1998 |
| KR | 100711373 | B1 | 4/2007 |

OTHER PUBLICATIONS

Machine-English translation of Japanese patent 2005-298964, Fujita Nobuhiro et al., Oct. 27, 2005.*

* cited by examiner

*Primary Examiner* — Deborah Yee
(74) *Attorney, Agent, or Firm* — The Webb Law Firm

(57) ABSTRACT

There are provided a steel for deep drawing, and a method for manufacturing the steel and a high pressure container. The steel for deep drawing includes, by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities, wherein a microstructure of the steel has a triphase structure of ferrite, bainite and martensite. The steel for deep drawing may be useful to further improve the strength without the deterioration of the toughness by adding a trace of Ti and B, compared to the conventional steels having a strength of approximately 1100 MPa. Also, the a method for manufacturing a steel may be useful to save the manufacturing cost and time by significantly curtailing time used in the spheroidization heat treatment during the deep drawing process, and to manufacture a steel for deep drawing that is used for a low-temperature, high-pressure container having a tensile strength of approximately 1200 Mpa by reducing a depth of the softening layer to prevent the deterioration in strength of the steel.

8 Claims, No Drawings

HIGH TENSILE STEEL FOR DEEP DRAWING AND MANUFACTURING METHOD THEREOF AND HIGH-PRESSURE CONTAINER PRODUCED THEREOF

TECHNICAL FIELD

The present invention relates to a steel for deep drawing that has a tensile strength of approximately 1200 MPa and is used for a low-temperature, high-pressure container, and a manufacturing method thereof, and more particularly, to a high-tensile strength steel for a low-temperature, high-pressure container, which secures low temperature toughness in the manufacture of the steel for a low-temperature, high-pressure container, a CNG storage container for automobiles and the like, reduces a drop of strength by decarburization by curtailing a required spheroidization heat treatment of steel, and shows its excellent economical efficiency and productivity, and a manufacturing method thereof.

BACKGROUND ART

To manufacture a steel for a low-temperature, high-pressure container having a high tensile strength (generally, of approximately 1100 MPa), a method of manufacturing a cylinder for a pressure container has been used in the prior art, which include: subjecting a seamless pipe to a spinning-type process. However, the cylinder prepared by the spinning-type process has problems in that the cylinder has a bad appearance due to the presence of seams in the cylinder, and its physical properties in the seamed portions may be deteriorated.

Also, since the steel is manufactured for purpose of the use in a seamless pipe, vanadium (V) used as a compound for carbide precipitation is often included in the steel after a quenching-tempering process. Therefore, when the steel is subject to a spheroidization heat treatment prior to the deep drawing process, the strength of steel is excessively enhanced by the V precipitation strengthening, which makes it difficult to directly use the steel in the deep drawing process.

In addition, the spheroidization heat treatment may be performed prior to the deep drawing process in order to give suitable workability to the steel. Here, when conventional steels are subject to the spheroidization heat treatment, the spheroidization heat treatment is carried out for a long time (i.e. at least 90 minutes). Therefore, the spheroidization heat treatment has problems in terms of its low steel productivity and high manufacturing cost, and the strength of steel may also be deteriorated due to the decarburization caused by the long-time spheroidization heat treatment.

DISCLOSURE OF INVENTION

Technical Problem

The present invention is designed to solve the problems of the prior art, and therefore it is an object of the present invention to provide a steel having an excellent low-temperature toughness and a tensile strength of approximately 1200 MPa, which is able to save the manufacturing time and cost by curtailing a time for the long-term spheroidization heat treatment, suppress the deterioration in the strength of steel caused by the decarburization, and give high workability to the steel by maintaining the strength of steel to 700 MPa or less after the spheroidization heat treatment.

Technical Solution

According to an aspect of the present invention, there is provided a steel for deep drawing, including, by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities, wherein a microstructure of the steel for deep drawing has a triphase structure of ferrite, bainite and martensite.

According to another aspect of the present invention, there is provided a method for manufacturing a steel for deep drawing, wherein the steel for deep drawing has a tensile strength of approximately 1200 MPa and a low-temperature impact toughness (at −50° C.) of 37 Joules or more, and also a method for manufacturing a high-pressure container made of the steel. Here, the method includes: heating a steel ingot at 1000 to 1250° C., the steel comprising, by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities (re-heating operation); rolling the re-heated steel ingot at a rolling finish temperature of 750 to 1000° C. (rolling operation); normalizing the rolled steel so that a microstructure of the steel is formed into a triphase structure of ferrite, bainite and martensite (normalizing operation); manufacturing a high-pressure container by subjecting the normalized steel to a spheroidization heat treatment at a temperature of $Ac_1$ to $Ac_3$ for at least 30 minutes and deep-drawing the heat-treated steel; maintaining at 850 to 950° C. for 1.9 t+5 to 1.9 t+30 minutes (wherein, t represents a thickness (mm) of steel) and quenching the steel; and tempering the quenched steel at 550 to 625° C.

Advantageous Effects

As described above, the steel according to one exemplary embodiment of the present invention may be useful to further improve the strength without the deterioration of the toughness by adding a trace of Ti and B, compared to the conventional steels having a strength of approximately 1100 MPa. Also, the method for manufacturing a steel according to one exemplary embodiment of the present invention may be useful to save the manufacturing cost and time by significantly curtailing a time for the spheroidization heat treatment during the deep drawing process, and to manufacture a steel for deep drawing that is used for a low-temperature, high-pressure container having a tensile strength of approximately 1200 MPa by reducing a depth of the softening layer to prevent the deterioration in strength of the steel.

BEST MODE FOR CARRYING OUT THE INVENTION

As described above, the exemplary embodiment of the present invention may provide a steel having a tensile strength of approximately 1200 MPa, and a suitable heat treatment method by means of an alloy design that is suitable for a deep drawing process. Therefore, there is provided a steel for a low-temperature, high-pressure container that has a smooth appearance, is seamless, and shows its excellent physical properties and productivity.

Hereinafter, the component systems and their limit ranges according to one exemplary embodiment of the present invention are described in detail (hereinafter, the term 'percent (%)' represents % by weight).

Carbon (C) is an element that is added to secure a desired strength of steel. Here, when the content of added C is too small, the strength of steel may be deteriorated severely, whereas weldability of steel may be deteriorated when the content of added C is too high. Therefore, the added C is used at a limited content of 0.25 to 0.40%.

Silicone (Si) functions as a deoxidizing agent that is required for a steel-making process, and also as a solid solution hardening element that affects the strength of steel. Therefore, Si is added in a content range of 0.15 to 0.40%.

Manganese (Mn) is an alloying element that has a significant effect on the strength and toughness of steel. Here, when the content of Mn is less than 0.4%, it is difficult to expect improvement in the strength and toughness of steel, and weldability of steel may be deteriorated and the expense for the alloying element may be increased when the content of Mn exceeds 1.0%. Therefore, Mn is used at a limited content of 0.4 to 1.0%.

Like Si, aluminum (Al) is one of potent deoxidizing agents used in a steel-making process. Here, when the content of added Al does not exceed 0.001%, its addition effect is slight. However, when the content of added Al exceeds 0.05%, its addition effect is not further improved. Therefore, Al is added within a content range of 0.001 to 0.05%.

Chromium (Cr) is an essential alloying element that is used to give hardenability to steel. In accordance with the present invention, Cr is added at a content of 0.8 to 1.2%. When the content of Cr is less than 0.8%, hardenability of steel may be deteriorated, which makes it difficult to secure the strength of steel, whereas the manufacturing cost may be increased when Cr is added at an excessive content of greater than 1.2%. Therefore, Cr is used at a limited content of 0.8 to 1.2%.

Molybdenum (Mo) is an alloying element that is effective to give hardenability to steel. And it has been also known as an element that prevents sulfide corrosion cracking. Also, Mo is an effective element to secure the strength of steel through the precipitation of fine carbide after the quenching-tempering process. Therefore, Mo is added in a content range of 0.15 to 0.8%.

Nickel (Ni) is a very effective element to improve low-temperature toughness of steel. However, since Ni is a very expensive element, Ni is added at a content of 1.0% or less according to one exemplary embodiment of the present invention.

Phosphorus (P) is an element that adversely affects low-temperature toughness of steel. However, a removal process of P in a steel-making process is very expensive. Therefore, P is used at a content of 0.015% or less according to one exemplary embodiment of the present invention.

In addition to P, sulfur (S) is an element that adversely affects low-temperature toughness of steel. However, a removal process of S in a steel-making process is very expensive. Therefore, S is used at a content of 0.015% or less.

Calcium (Ca) functions to reduce anisotropy of materials according to the rolling directions after the spheroidization and rolling of an inclusion, such as MnS, that is extended in a rolling direction. However, when the content of Ca is less than 0.0005%, it is difficult to expect the spheroidization of the inclusion, whereas the inclusion may be rather increasingly formed when the content of Ca exceeds 0.002%. Therefore, Ca is used at a limited content of 0.0005 to 0.002%.

Boron (B) is a core element added in the present invention that is able to enhance the hardenability of steel, which leads to the strengthening of steel. Here, when the content of B is less than 0.0005%, it is difficult to expect significant improvement in the hardenability of steel. On the contrary, when B is added at an excessive content of greater than 0.0025%, its addition effect is not further improved. Therefore, B is used at a limited content of 0.0005 to 0.0020%.

Titanium (Ti) functions as an element that maximizes the addition effect of B. Therefore, Ti is added at a content of 0.005% or more. In particular, when steel is subject to the spheroidization heat treatment by adding Ti together with B according to one exemplary embodiment of the present invention, the depth of the softening layer formed by the decarburization may be reduced to a depth of 1 mm or less, which leads to the minimized deterioration of steel strength. However, the manufacturing cost may be increased when Ti is added at an excessive content of greater than 0.025%. Therefore, Ti is added at a limited content of 0.005 to 0.025%.

Hereinafter, the method for manufacturing a steel according to one exemplary embodiment of the present invention, and its conditions are described in more detail.

First, a steel ingot was re-heated at 1000 to 1250° C. so as to prepare a steel according to one exemplary embodiment of the present invention. When a re-heating temperature is below 1000° C., it is difficult to form solute components into a solid solution, whereas physical properties of steel may be deteriorated due to a very coarse size distribution of austenite crystal grains when the re-heating temperature exceeds 1250° C.

Also, a rolling finish temperature is defined to a temperature range of 750° C. to 1000° C. according to one exemplary embodiment of the present invention. When the rolling finish temperature is below 750° C., a rolling ratio is excessively increased in a non-recrystallized region of austenite to form the anisotropy of materials, which leads to the deteriorated deep drawing property of steel. On the contrary, when the rolling finish temperature exceeds 1000° C., the crystal grains may be coarsely distributed, which adversely affects the physical properties of steel.

A steel sheet rolled under the above-mentioned conditions is subject to the conventional normalizing heat treatment so that a microstructure of the steel sheet can have a triphase structure of ferrite, bainite and martensite. This triphase structure may be regarded as structure that is used to curtail a time for spheroidization heat treatment to a desired time according to one exemplary embodiment of the present invention, as well as to have an effect to increase the strength of martensite and bainite.

In the case of the low-temperature transformation structure such as martensite, bainite, pearlite and the like, the finer carbide grains are, the faster the spheroidization rate is. In general, it has been known that the spheroidization rate is in an order of martensite>bainite>pearlite, and therefore the spheroidization time may be curtailed in the order.

Therefore, the steel, which has the above-mentioned triphase structure so that the microstructure of the steel can be composed of 10 to 40% of ferrite, 10 to 40% of bainite and 20 to 80% of martensite, is prepared according to one exemplary embodiment of the present invention. A very high fraction of ferrite and very low fractions of bainite and martensite leads to the deteriorated strength of steel, whereas the very high fraction of ferrite results in the deteriorated deep drawing property of steel.

The steel prepared under the above-mentioned conditions is subject to the spheroidization heat treatment, such that suitable workability can be given to the steel prior to the deep drawing process. In this case, the steel having a tensile strength of 700 MPa or less is prepared prior to the deep drawing process by maintaining the heat-treated steel at a temperature of $Ac_1$ to $Ac_3$ for at least 30 minutes, preferably for 30 to 90 minutes. The temperature of $Ac_1$ to $Ac_3$ is in a temperature range for spheroidization heat treatment according to one exemplary embodiment of the present invention. When the spheroidization heat treatment is carried out at a temperature below the above temperature range, the spheroidization time is too long. On the contrary, when the spheroidization heat treatment is carried out at a temperature greater than the above temperature range, a phase transformation into austenite may be caused, which makes it difficult to form spheroidized carbides. Therefore, the spheroidization heat treatment is carried out in the temperature range of $Ac_1$ to $Ac_3$.

Considering that 90 minutes as the time for spheroidization heat treatment are required for the conventional steels for deep drawing, the curtailment of the time for spheroidization heat treatment is very important in terms of the reduction in the energy and manufacturing cost.

After the deep drawing process of the steel, it is also necessary to obtain a steel having a tensile strength of 1200 MPa. For this purpose, an inner structure of the steel should be necessarily transformed into an austenite structure. Therefore, the steel is cooled with water (quenched) after the steel is kept at a suitable temperature of 850 to 950° C. Where the quenching temperature is below 850° C., it is difficult to form solute components into a solid solution again, which makes it difficult to secure the strength of steel. On the contrary, when the quenching temperature exceeds 950° C., the crystal grains grow in the solid solution, which adversely affects the low-temperature toughness of steel.

Furthermore, the quenched steel is tempered at 550 to 625° C. Here, when the tempering temperature is below 550° C., it is difficult to secure the toughness of steel, whereas it is difficult to secure the strength of steel when the tempering temperature exceeds 625° C.

The steel for deep drawing used for a high-pressure container has a tensile strength of approximately 1200 MPa, and shows its low-temperature impact toughness at −50° C. of 37 Joules or more as well. Therefore, it is revealed that the steel for deep drawing shows its wide utilities and very excellent physical properties. Also, when steel articles are subject to the spheroidization heat treatment, the depth of the softening layer is significantly reduced compared to the conventional steel articles due to the decarburization in a surface of the steel, which makes it possible to solve the above problem associated with the deteriorated strength of the steel caused by the heat treatment.

MODE FOR THE INVENTION

Hereinafter, the steel and the manufacturing method thereof according to one exemplary embodiment of the present invention are described in more detail.

Examples

Each slab having compositions as listed in the following Table 1 was prepared under the conditions as listed in the following Table 2, and measured for physical properties. Then, the results are listed in the following Table 3.

TABLE 1

| | C | Mn | Si | P | S | Si | Cr | Mo | Ca | Ti | Al | B |
|---|---|---|---|---|---|---|---|---|---|---|---|---|
| Inventive Steel A | 0.35 | 0.85 | 0.25 | 0.011 | 0.002 | 0.51 | 0.92 | 0.44 | 0.0016 | 0.015 | 0.0033 | 0.0010 |
| Inventive Steel B | 0.36 | 0.80 | 0.26 | 0.008 | 0.003 | 0.48 | 1.01 | 0.52 | 0.0012 | 0.012 | 0.0028 | 0.0020 |
| Comp. Steel C | 0.35 | 0.81 | 0.24 | 0.010 | 0.003 | 0.29 | 0.89 | 0.25 | 0.0007 | — | 0.0030 | — |

TABLE 2

| Kinds of Steels | | | Rolling finish Temp. (° C.) | Spheroidization Temp. (° C.) | Spheroidization time* (Min.) | Quenching Temp. (° C.) | Tempering Temp. (° C.) |
|---|---|---|---|---|---|---|---|
| Inventive Steels | A | 1 | 870 | 750 | 40 | 885 | 565 |
| | A | 2 | 880 | 760 | 38 | 890 | 550 |
| | A | 3 | 905 | 780 | 35 | 895 | 565 |
| | B | 4 | 900 | 740 | 40 | 890 | 570 |
| | B | 5 | 875 | 760 | 39 | 885 | 575 |
| | B | 6 | 860 | 780 | 36 | 900 | 550 |
| Comp. Steels | C | 7 | 850 | 780 | 95 | 880 | 550 |
| | C | 8 | 900 | 740 | 100 | 900 | 575 |
| | C | 9 | 950 | 740 | 105 | 900 | 570 |

*Spheroidization time: a minimum time (min) for spheroidization heat treatment to obtain a steel having a tensile strength of 650 MPa after the spheroidization heat treatment As listed in Table 2, it was revealed that the time for spheroidization heat treatment of the Inventive steels is relatively shorter than the time for spheroidization heat treatment of the Comparative steels. Therefore, it was considered that the relatively short time for spheroidization heat treatment is effective to reduce the manufacturing cost and prevent the physical properties from being deteriorated due to the decarburization phenomenon.

TABLE 3

| Kinds of Steels | | | Rlling finish Temp. (° C.) | Tensile Strength (MPa) | Elongation (%) | Impact toughness @ −50° C. (J) | Depth** of softening layer (mm) |
|---|---|---|---|---|---|---|---|
| Inventive Steels | A | 1 | 870 | 1209 | 15 | 60 | 0.50 |
| | A | 2 | 880 | 1215 | 14 | 61 | 0.51 |
| | A | 3 | 905 | 1210 | 17 | 63 | 0.49 |
| | B | 4 | 900 | 1203 | 16 | 61 | 0.48 |
| | B | 5 | 875 | 1205 | 15 | 65 | 0.49 |
| | B | 6 | 860 | 1218 | 14 | 61 | 0.50 |
| Comp. Steels | C | 7 | 850 | 1142 | 16 | 62 | 1.43 |
| | C | 8 | 900 | 1112 | 15 | 67 | 1.40 |
| | C | 9 | 950 | 1110 | 18 | 66 | 1.35 |

**Depth of softening layer depth: a depth (mm) of a softening layer, which is subject to the decarburization, from a surface of steel after the deep drawing and heat treatment processes Also as listed in Table 3, it was revealed that, although the Inventive steels according to one exemplary embodiment of the present invention were prepared within the relatively short time for spheroidization heat treatment as listed in Table 2, the steel for deep drawing having a tensile strength of approximately 1200 Mpa, which is able to secure excellent tensile strength and impact toughness, may be prepared by significantly reducing the depth of the softening layer.

The invention claimed is:

1. A steel for deep drawing, comprising, by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities, wherein the steel comprises spheroidized carbides and a surface softening layer whose thickness is 1 mm or less through a normalizing process and a spheroidization heat treatment for 30 to 90 minutes.

2. A high-pressure container comprised of a steel, which comprises by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities, wherein the steel comprises spheroidized carbides and a surface softening layer whose thickness is 1 mm or less through a normalizing process and a spheroidization heat treatment, and wherein the steel has a tensile strength of 1200 MPa or more and a low-temperature impact toughness at −50° C. of 37 Joules or more.

3. A method for manufacturing a steel for deep drawing, comprising:

re-heating a steel ingot at 1000 to 1250° C., the steel comprising, by weight: C: 0.25 to 0.40%, Si: 0.15 to 0.40%, Mn: 0.4 to 1.0%, Al: 0.001 to 0.05%, Cr: 0.8 to 1.2%, Mo: 0.15 to 0.8%, Ni: 1.0% or less, P: 0.015% or less, S: 0.015% or less, Ca: 0.0005 to 0.002%, Ti: 0.005 to 0.025%, B: 0.0005 to 0.0020% and the balance of Fe and inevitable impurities;

rolling the re-heated steel ingot at a rolling finish temperature of 750 to 1000° C.;

normalizing the rolled steel so that a microstructure of the steel is formed into a triphase structure of ferrite, bainite and martensite; and spheroidizing the normalized steel at a temperature of $Ac_1$ to $Ac_3$ for at least 30 minutes.

4. The method of claim 3, wherein, in the normalized condition, the microstructure of the steel is composed of 10 to 40% of ferrite, 10 to 40% of bainite and 20 to 80% of martensite.

5. The method of claim 3, further comprising:

deep drawing the spheroidized steel.

6. The method of claim 5, wherein, after the spheroidization heat treatment, a softening layer formed in a surface of the steel has a depth of 1 mm or less.

7. The method of claim 3, further comprising:

maintaining at 850 to 950° C. for 1.9 t+5 to 1.9 t+30 minutes and quenching the steel, wherein t denotes a thickness (mm) of the steel; and tempering the quenched steel at 550 to 625° C.

8. The method of claim 7, wherein, after the quenching and the tempering, the steel has a tensile strength of 1200 MPa or more and a low-temperature impact toughness at −50° C. of 37 Joules or more.

* * * * *

UNITED STATES PATENT AND TRADEMARK OFFICE

CERTIFICATE OF CORRECTION

PATENT NO. : 8,652,273 B2
APPLICATION NO. : 12/741703
DATED : February 18, 2014
INVENTOR(S) : Hong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 184 days.

Signed and Sealed this
Twenty-ninth Day of September, 2015

Michelle K. Lee

Michelle K. Lee
*Director of the United States Patent and Trademark Office*